US005530415A

United States Patent [19]

Takaya et al.

[11] Patent Number: 5,530,415

[45] Date of Patent: Jun. 25, 1996

[54] COMPOSITE WINDING TYPE STACKED-LAYER INDUCTORS INCLUDING SELF INDUCTIVE INDUCTORS AND MANUAL-INDUCTIVE INDUCTORS

[75] Inventors: Minoru Takaya; Atsushi Sato; Akihiko Fujisawa, all of Tokyo, Japan

[73] Assignee: TDK Corporation, Tokyo, Japan

[21] Appl. No.: 207,882

[22] Filed: Mar. 7, 1994

Related U.S. Application Data

[63] Continuation of Ser. No. 560,165, Jul. 31, 1990, abandoned.

[30] Foreign Application Priority Data

Aug. 1, 1989 [JP] Japan ..... 1-198006
Aug. 1, 1989 [JP] Japan ..... 1-198007

[51] Int. Cl.[6] ..... H01F 27/30

[52] U.S. Cl. ..... 336/83; 336/180; 336/200; 336/233

[58] Field of Search ..... 336/200, 232, 336/180, 182, 69, 183, 233, 83; 333/24 R, 25

[56] References Cited

U.S. PATENT DOCUMENTS 4,313,151 1/1982 Vranken ..... 336/232
4,313,152 1/1982 Vranken ..... 336/232
4,322,698 3/1982 Takahashi et al. ..... 336/200
4,816,784 3/1989 Rabjohn ..... 336/232

FOREIGN PATENT DOCUMENTS 56-91406 7/1981 Japan ..... 336/200
58-61609 10/1981 Japan ..... 336/200
6424407 1/1989 Japan .

*Primary Examiner*—Thomas J. Kozma
*Attorney, Agent, or Firm*—Wood, Phillips, VanSanten, Clark & Mortimer

[57] ABSTRACT

A composite winding type inductor having a stacked-layer structure formed by stacking a plurality of sets of electrically conductive strips for forming plural sets of coils alternately with a plurality of electrically insulting members. The electrically conductive strips in each of the sets are connected to the adjacent ones by way of edges of the electrically insulating members to thereby form a coil. A plurality of the coils thus formed turn around substantially a generally common axis. At least two of the plural sets of the electrically conducting strips are stacked in layers in such a manner as to follow spiral paths in the directions apposite to each other. The coils formed by at least two sets of the electrically conductive strips are connected to each other at least at one of a start end portion, an intermediate portion and a terminal end portion of the coil. A method of manufacturing the inductor by stacking the conductor strips and the insulating layers alternately with each other by a printing method, vapor phase method such as evaporation and CVD as well as transformers by combining the inductors.

5 Claims, 13 Drawing Sheets

COMPOSITE WINDING TYPE STACKED-LAYER INDUCTORS INCLUDING SELF INDUCTIVE INDUCTORS AND MANUAL-INDUCTIVE INDUCTORS

This application is a continuation of application Ser. No. 560,165, filed Jul. 31, 1990, now abandoned.

BACKGROUND OF THE INVENTION

1. Field of the Invention

The present invention relates generally to inductors of a laminated or stacked-layer structure including self-inductive inductors and mutual-inductive inductors. More particularly, the present invention is concerned with composite winding type stacked-layer inductors including self-inductive inductors and mutual-inductive inductors such as transformers.

With the phrase "composite winding type laminated or stacked-layer inductor", it is intended to mean an inductor of such a structure which includes plural sets of electric conductor windings formed in parallel through a layer stacking or layering process by making use of a conventional printing method, vapor phase methods such as sputtering, evaporation and CVD methods or others. Further, with the term "inductor", it is contemplated to mean an inductor realized by a single winding or by a plurality of electric conductor windings connected in series to form a self-inductive inductors or in parallel to form a mutual-inductive inductor or transformer. The inductor of concern can be used not only alone but also in combination with the inductor(s) according to the invention or other inductor(s) known heretofore to thereby form transformers or the like. Besides, the inductor can find a variety of applications such filter circuits, composite LC-circuit chips, composite LR-circuit chips, composite LCR-circuit chips and other various integrated circuits incorporating other circuit elements such as diodes, transistors, thermistors and/or the like. To say in another way, the composite winding type stacked-layer inductor according to the present invention can be employed for any applications which require the inductor as the indispensable circuit constituent. Thus, the inductor according to the invention is never limited to the independent utilization thereof.

2. Description of the Related Art

In the Japanese Patent Publication No. 39521/1982, Japanese Patent Application Kokai No. 22304/1984, Japanese Patent Publication No. 14487/1988 and U.S. Pat. No. 4,322,698 filed in the name of the inventors of the present application, there are proposed such an integrated structure of a sintered stacked-layer inductor in which magnetic ferrite layers and coil-forming strip-like conductor layers are deposited or stacked alternately with each other and subsequently sintered into an integral structure. In the stacked-layer inductors according to these preceding proposals, a plurality of printed conductor strip layers each having a length corresponding to about a half turn are mutually interconnected byway of edge portions of the printed ferrite magnetic layers intervening the conductor strip layers so that the conductor strip layers each of abut a half turn cooperate to constitute a coil wound in the direction in which the layers are stacked, whereon the whole coil thus obtained is then sintered to an integral structure.

In the following, the prior art techniques relating to the present invention will be described in some detail by referring to FIGS. 83 to 112 of the accompanying drawings for having a better understanding of the invention. Parenthetically, in the stacked-layer inductor manufacturing process, it is commonly practiced to implement simultaneously a plurality of stacked-layer inductors on a single delamination-easy (i.e. easily removable or separable) substrate having a large surface area. However, the following description will be made on the assumption that a single stacked-layer inductor is to be manufactured only for convenience of the description. In the drawings mentioned above, the figures labelled with (a) show plan views with those labeled (b) showing sectional views.

Referring to FIGS. 83 to 97 showing a first prior art technique, an easily strippable or delamination-easy substrate (not shown) having a polyester layer (preferably a polyethylene terephthalate layer) deposited over a surface of a substrate material (such as aluminium and the like) having high flatness and smoothness is printed with an magnetic ferrite layer 1 having an electrically insulating property and a magnetic permeability, which layer may have a surface deposited with an electrically insulating coating. Next, printed on the magnetic ferrite layer 1 in such a pattern as illustrated in FIG. 84 is a ferrite layer 2 for compensating for a print offset (difference in the thickness) which would otherwise be produced through the printing process, being then followed by the printing of a coil lead-out conductor strip 3 as shown in FIG. 85. Subsequently, a magnetic ferrite layer 5 is printed over a right half so that a start end portion 4 of the coil lead-out conductor strip 3 remains exposed, as shown in FIG. 86. Next, an electrically conductive strip 6 for forming about a half turn of the coil is printed so as to be connected to the start end portion 4, as shown in FIG. 87, which is then followed by the printing of a magnetic ferrite layer 7 over a left half of the surface in such a manner that an end portion of the coil forming conductor strip 6 remains exposed. Subsequently, a coil forming conductor strip 9 for forming about a half turn of the coil is printed in electrical contact with the end portion 8 of the coil forming conductor strip 6, as illustrated in FIG. 89. Next, a magnetic ferrite layer 11 is printed over the right half with an end portion 10 of the coil forming conductor strip 9 being left as exposed, as shown in FIG. 90. At a next step, a coil forming conductor strip 12 is printed for forming about a half turn of the coil in contact with the end portion 10 of the coil forming conductor strip 9, as shown in FIG. 91. Subsequently, a magnetic ferrite layer 13 is printed over the left half with an end portion 14 of the coil forming conductor strip 12 being left exposed, as shown in FIG. 92, being then followed by the printing of a coil forming conductor strip 15 for forming about a half turn of the coil in contact with an end portion 14 of the coil forming conductor strip 12, as shown in FIG. 93. Then, a magnetic ferrite layer 17 is printed on the right half. Through the stacking process up to the step shown in FIG. 92, there are deposited in a stacked or laminated structure the conductor Strips 3, 6, 9, 12 and 15 which cooperate to form a coil of about two turns. For realizing the coil having a desired number of turns, the conductor strip stacking steps similar to those shown in FIGS. 91 to 94, respectively, my be repeated for a corresponding number of times. For convenience of description, let's assume that the layer stacking process is terminated at the manufacturing step shown in FIG. 94. After having formed the coil forming conductor strips corresponding to desired number of turns in general and in the simplified example the two turns, a coil lead-out electrical conductor strip 18 is printed, as shown in FIG. 95. Subsequently, a magnetic ferrite layer 19 is printed over the whole surface, as shown in FIG. 96, whereon the product thus obtained is sintered. Finally, terminals required for external connection are formed by baking or the like method. Thus, a stacked-layer inductor is finished. An equivalent electric circuit diagram of the stacked-layer inductor is illustrated in FIG. 97.

A method of manufacturing a stacked-layer inductor according to another printer art technique is illustrated in FIGS. 98 to 112 of the accompanying drawings. (Concerning this prior art, reference may be made to JP-A-59-22304). These figures show in plan views a process for manufacturing a stacked-layer inductor by making use of a layer stacking technique such as a printing method, a vapor phase method typified by sputtering, evaporation and others. The stacked-layer inductor as illustrated is manufactured by resorting to a printing method.

More specifically, FIGS. 98 to 107 show in plan views a process of manufacturing a composite winding type stacked-layer inductor according to the prior art technique in which the axis of turns of a primary coil winding formed by stacked conductor strips and extending from a point $P_1$ to a point $P_2$ is deviated or offset from the axis of turns of a secondary coil winding extending from a point $S_1$ to a point $S_2$. The stacked-layer inductor now under consideration is destined to be used as a transformer. On the other hand, FIGS. 108 to 112 show a process of manufacturing a composite winding type stacked-layer inductor having the concentric axes of turns formed by the coil forming conductor strips deposited concentrically, whereby the primary winding forming conductor strips are disposed coaxially with the secondary winding forming conductor strips.

Describing the second prior art method, a magnetic layer 31 of magnetic ferrite or the like material is printed on a delamination-easy substrate (not shown), and then a primary winding conductor strip 32 is printed on the magnetic layer 31 about a half turn, as shown in FIG. 98. An end portion P1 of the conductor strip 32 is lead out to a peripheral portion of the magnetic layer 31. Next, the conductor strip 32 is covered with another magnetic layer 34 except for an end portion 33 of the conductor strip 32, as shown in FIG. 99. Subsequently, a secondary winding conductor strip 35 having a lead-out end portion $S_1$ is printed about a half turn and simultaneously connected to the end portion 33 of the conductor strip 32 to thereby form a conductor strip 36 of about a half turn. Next, a further magnetic layer 39 is deposited by printing on the conductor strips 35 and 36 with end portions 37 and 38 thereof being left exposed, as can be seen in FIG. 100. At a next step, conductor strips 40 and 41 are printed each about a half turn in contact with the end portions 37 and 38, respectively. Thereafter, a magnetic layer 44 is deposited by printing in such a pattern that the end portions 42 and 43 of the conductor strips 40 and 41 are left exposed, which is then followed by the printing of conductor strips 45 and 46 each corresponding to a half turn in contact with the end portions 42 and 43, respectively, as shown in FIG. 101. Next, a magnetic layer 47 is printed as in the case of the magnetic layer 39, whereby the conductor strip 46 is lead out to the terminal end $P_2$ on the right side through the medium of a conductor strip 48 while the conductor strip 45 is extended by a conductor strip 49 corresponding to about a half turn, as will be seen in FIG. 102. Next, a magnetic layer 50 is printed in a manner similar to the case of the magnetic layer 44, wherein an end portion of the conductor strip 49 is lead out to a terminal end $S_2$ on the left side of the stacked layer structure by printing a conductor strip 51, as shown in FIG. 103. Finally, a magnetic layer 52 is printed over the whole surface, as shown in FIG. 104. For implementing the primary coil winding conductor strips or the secondary coil winding conductor strips with a described number of turns, the layer stacking steps shown in Figs, 100 to 101 are repeated a requisite number of times. After having stacked a desired number of the conductor strips, the stacked layer structure is then subjected to a sintering process, whereon electrically conductive paste of suitable types are baked to the lead-out end portions $P_1$, $P_2$, $S_1$ and $S_2$, respectively. Thus, there can be obtained a stacked layer-inductor chip.

Next, a stacked layer inductor manufactured according to a third prior art method illustrated in FIGS. 108 to 112 will briefly be described. (Concerning this prior art, reference may be made to JP-A-59-22304.)

Describing the third prior art inductor, a magnetic layer 62 is printed on a delamination-easy substrate (not shown), being followed by the printing of a conductor strip 63 on the surface of the magnetic layer 62 for forming a part of the primary coil winding of about a half turn which has a lead-out end portion $P_1$, as can be seen in FIG. 108. Subsequently, a magnetic layer 64 is printed with a portion of the conductor strip 63 being left exposed, whereon a conductor strip 65 of about a half turn is printed in contact with one end portion of the conductor strip 63, while a conductor strip 66 is printed for forming about a half turn of the secondary coil winding extending from a lead-out end $S_1$ located on the right side, as can be seen in FIG. 109. Subsequently, a magnetic layer 67 is printed with end portions of the conductor strips 65 and 66 being left exposed, whereon conductor strips 68 and 69 each of about a half turn is printed while making contact with the end portions of the conductor strips 65 and 66, respectively, as shown in Fig. [10. Next, after having printed a magnetic layer 70 a conductor strip 71 is so printed as to extend from the exposed end of the conductor strip 68 to the lead-out end portion $P_2$ located on the left side of the stacked-layer structure, while a conductor strip 72 of a substantially U-like shape is so printed as to extend from the exposed end of the conductor strip 69 to the lead-out end portion $S_2$ on the right side of the stacked-layer structure, as can be seen in FIG. 111. It will readily be understood that a stacked-layer inductor having a desired number of turns of the winding can be obtained by repeating the layer stacking step shown in FIG. 110 and a subsequent similar step but with the pattern in FIG. 110 is turned by 180 degrees about the axis normal to the sheet a corresponding number of times.

After having completed the stacking o#the layers corresponding to a desired number of tuns, a magnetic layer 73 is printed and then the whole structure is sintered with terminals $S_1$, $S_2$, $P_1$ and $P_2$ for external connection being formed by baking, whereby a stacked layer inductor chip can be obtained, as shown in FIG. 112.

Further, it has also been proposed to combine two or more inductors in a composite structure for use as a transformer having an intermediate or center tap. To this end, there is known a method of providing a center or intermediate tap 237 exemplified in FIG. 125 in the course of manufacturing process (according to a fourth prior art method) illustrated in FIGS. 116 to 125 of the accompanying drawings or a method of providing a center or intermediate tap 299 as illustrated in FIG. 126 on the way in carrying out the manufacturing process described previously in conjunction with FIGS. 83 to 96 (first prior art method).

Now referring to FIGS. 116 to 125, a magnetic ferrite layer 241 of an electrically insulating material is printed over a whole surface of a delamination-easy substrate (not shown), whereon a conductor strip 243 for forming a primary coil is printed about a half turn on the magnetic ferrite layer 241 and lead outwardly to the left to thereby form a lead-out portion 245, being then followed by the printing of a conductor strip 243' of about a half turn for forming the secondary coil, the conductor strip 243' being lead outwardly to the right to form a lead-out portion 245'. For forming the center or intermediate tap, the lead-out portions 245 and 245' are baked, as described hereinafter, whereon terminal 269 and 273 may be attached externally as shown in FIG. 125 or alternatively the conductor strips 243 and 243' may be connected to each other by printing. The conductor strips 243 and 243' constituting parts of the primary and secondary coils, respectively, are printed, being distanced from each other in the horizontal direction as viewed in the drawings. Next, a magnetic ferrite layer 249 is printed with end portions 247 and 247' of the conductor strips 243 being left exposed, respectively, as shown in FIG. 117. Subsequently, conductor strips 251 and 251' are printed each about a half turn in contact with the end portions 247 and 247', respectively, as shown in FIG. 118. Thereafter, a magnetic ferrite layer 255 is printed with end portions 253 and 253' of the conductor strips 251 and 251' being left exposed, as shown in FIG. 119, in succession to which conductor strips 257 and 257' are printed each about a half turn in contact with the end portions 253 and 253', respectively, as shown in FIG. 120. Subsequently, a magnetic ferrite layer 261 is so printed that the end portions of the conductor strips 257 and 257' are left exposed, as shown in FIG. 121. For realizing the coils each having a desired number of turns, the layer stacking steps shown in FIGS. 117 and 120 may be repeated a requisite number of times. After having completed the stacking of the layers in a desired number, conductor strips 263 and 263' are so printed as to be connected to the end portions 259 and 259' of the conductor strips 257 and 257', respectively, and then lead outwardly to the left and the right to thereby form lead-out portions 265 and 265', respectively, as shown in FIG. 122. Next, a magnetic ferrite layer 267 is printed over the whole surface, as shown in FIG. 123, whereon the stacked-layer structure is sintered. Finally, terminals 269, 271, 273 and 275 required for external connection are formed by baking. Thus, a stacked layer or laminated transformer provided with a center or intermediate tap can be obtained. FIG. 125 shows schematically an equivalent electric circuit diagram of this stacked-layer transformer with the intermediate tap.

Another example of the process for manufacturing a stacked-layer transformer having an intermediate tap (according to fifth prior art method) will be described by making reference to the manufacturing process shown in FIGS. 83 to 99 (according to the first prior art method). In the case of the instant example, an electrical conductor (not shown) to be lead out from the conductor 9 to the right side of the stacked-layer structure is simultaneously printed upon carrying out the step shown in FIG. 89. In this way, an inductor or a transformer having an intermediate tap 299, a primary tap 285 and a secondary tap 295, as shown in FIG. 126, can be implemented.

The stacked-layer transformer having the intermediate tap realized through the layer stacking steps illustrated in FIGS. 116 to 124 suffers from a problem that the width is increased, although the transformer can enjoy an advantageous effect that the thickness is reduced by virtue of the fact that the primary coil and the secondary coil are constituted by the layers stacked in parallel. On the other hand, the stacked-layer transformer with the intermediate tap shown in FIG. 126 in which the primary and secondary coils are realized by stacking sequentially the layers presents a problem that the thickness is increased, although the width of the stacked-layer transformer can well be controlled in respect to the width to an advantageous effect. Thus, none of the stacked-layer transformers described above cannot sufficiently satisfy the requirements imposed for miniaturization as demanded in the field of this art.

In conjunction with the bifilar winding process illustrated in FIGS. 98 to 107 (according to the second prior art method), it is noted that a transformer having an equivalent circuit configuration shown in FIG. 162 can be obtained by providing a lead-out conductor (not shown) which extends from the conductor 41 to the right edge of the stacked-layer structure at the step shown in FIG. 100.

The bifilar winding type stacked-layer transformer shown in FIGS. 98 to 112 is disadvantageous in that the overall thickness is increased because no more than two electric conductors for the coils can be provided in each of the layers. Further, in the case of the bifilar winding type stacked-layer transformer shown in FIG. 163 in which a pair of primary and secondary coils can be realized by stacking the corresponding layers continuously by way of the intermediate tap (c) suffers from a problem that the thickness is increased, although the width of the stacked-layer transformer can advantageously be controlled with regard to the dimension of the width.

SUMMARY OF THE INVENTION

The inductors of the stacked-layer structure or laminated structure find applications in general in a variety of circuits such as filter circuits, intermediate frequency (IF) transformers and others and are used or operated in numerous frequency bands. Such being the circumstances, it is desirable that the inductance L of the inductor can be varied over a wide range. In general, the stacked-layer inductor has inductance L (in H) given by the following expression:

$$L = \frac{A}{l}\ 4\pi\mu_e N^2 \times 10^{-9} \tag{1}$$

where A represents a sectional area ($m^2$) of a coil winding, l represents the length of magnetic path (m), $\mu_e$ represents the effective magnetic permeability (Wb/A. m), and N represents the number of turns. As is apparent from the expression (1), it is most effective to increase the number of turns (N) in order to increase the inductance L. Needless to say, the inductance increases in proportion to the second power of the number of turns ($N^2$).

In the case of the stacked-layer inductor described hereinbefore in conjunction with FIGS. 83 to 96, the coil forming conductor strips 3, 6 and 9 are formed abut one turn through the printing steps up to that shown in FIG. 89. This means that any more than a single turn can not be realized by the coil forming conductor strips in a thickness corresponding to at least as many as five layers including the magnetic ferrite layers and the coil forming conductor strips (the number of the layers amounts to six when the ferrite layer 5 is formed for compensating for the print offset described hereinbefore in conjunction with FIG. 83 on the on the hand, in the case of the stacked-layer inductors described hereinbefore by reference to FIGS. 98 to 107 and FIGS. 108 to 112, the directions of magnetic fluxes generated by the individual coils upon electrical energization thereof are opposite to one another because of the same direction of turns. Accordingly, it is impossible to increase the inductance. In other words, these prior art methods are concerned with the realization of the so-called bifilar coil. Accordingly, in order to use this coil as an inductor the terminals $P_2$ and $S_1$, for example, must be connected via an external conductor. The same applied to the other prior art inductors described above.

In view of the state of the prior art described above, the inventors of the present application have developed a composite winding type stacked-layer inductor and a method of manufacturing the same in which the inductance L thereof can be remarkably increased while suppressing the thickness of the stacked layers to a possible minimum.

The principle underlying the present invention will be described by reference to FIG. 27 of the accompanying drawings. In this figure, a coil winding extending between points $P_1$ and $P_2$ has turns of the clockwise direction as viewed from the left to the right in the drawing while a coil winding extending between points $S_1$ and $S_2$ has turns of the counterclockwise direction as viewed from the right to the left in the drawing. This definition concerning the directions of the turns of the coil or the winding applies valid throughout the specification. Now referring to FIG. 27, it will be understood that when the terminal end $P_2$ of the coil winding of clockwise turns is connected to the terminal end $S_2$ of the coil winding of counterclockwise turns, the coil resulting from the connection mentioned above has the whole winding which extends from the start end $P_1$ to the terminal end $S_1$ constantly with the turns of the clockwise direction. To say in another way, when a pair of coil windings having respective turns in the directions opposite to each other are connected at the terminal ends or at the start ends of the windings, there can be obtained a combined or composite coil winding which has the turns of the same direction as a whole. The inventors have discovered that by applying the abovementioned fact or principle to the patterned forming of electric conductor layers or strips of the stacked-layer inductor, the number of turns of the inductor coil can be increased twice or more as compared with that of the prior art inductor for a given thickness of the stacked layers. In other words, there can be realized an stacked-layer inductor which has the number of turns twice or more as large as that of the prior art inductor with a substantially same thickness of the stacked-layer structure, which in turn means that inductance of the inductor according to the present invention can be increased about four times as high as that of the prior art inductor.

Accordingly, an object of the present invention is to provide an inductor of an improved structure which is capable of exhibiting a significantly high inductance without need for increasing the thickness of the stacked-layer structure.

A further object of the present invention is to proved a method of manufacturing the inductor of the improved structure mentioned above.

In view of the above and other objects which will be apparent as description proceeds, there is provided according to a general aspect of the present invention a composite winding type stacked-layer inductor having a stacked-layer structure formed by stacking plural sets of electrically conductive strips for forming plural sets of coils alternately with a plurality of electrically insulting members, wherein the electrically conductive strips in each set are connected to the adjacent ones by way of edges of the electrically insulating member to thereby form a coil, a plurality of the coils thus formed turn around generally common i.e., closely spaced, at least two of the plural sets of the electrically conductive strips are stacked in layers in such a manner as to follow spiral paths superposed at two positions per turn of the spiral paths in the directions opposite to each other, and wherein the coils formed by the two sets of the electrically conductive strips are connected to each other at a start end portion, an intermediate portions and/or a terminal end portion of the coil. The spiral paths can be superposed or side-by-side.

Further, according to another aspect of the invention, there is provided a method of manufacturing a composite winding type stacked-layer inductor by printing in the form of stacked layers a plurality of sets of electrically conductive strips alternately with a plurality of electrically insulating layers by using a paste of pulverized electrically conductive material and a paste of pulverized electrically insulating material for thereby forming plural sets of coils turning substantially around a generally common axis, which method comprises a first step of depositing by printing an electrically insulating layer over a delamination-easy substrate, a second step of depositing by printing plural sets of electrically conductive strips in such a manner that at least two sets of electrically conductive strips form coils wound in the directions opposite to each other, a third step of depositing by printing an electrically insulating layer in such a pattern that terminal end portions of the electrically conductive strips are left exposed, a fourth step of depositing by printing on the electrically insulating layer second plural sets of electrically conductive strips having start end portions connected to the corresponding terminal end portions of the plural sets of the electrically conductive strips formed at the second step, a fifth step of repeating the second to third steps a desired number of times, a sixth step of depositing an electrically insulating layer over the whole surface of the stacked-layer structure thus formed, a seventh step of interconnecting at least two sets of the coils of turns in the opposite directions by printing at portions located closest to each other at one of the first, intermediate and final depositing steps, and an eighth step of detaching the substrate.

The composite-winding type stacked-layer inductor according to the present invention can also be manufactured by a vapor phase method. Accordingly, there is further provided according to still another aspect of the invention a method of manufacturing a composite winding type stacked-layer inductor by depositing in the form of stacked layers a plurality of sets of electrically conductive strips alternately with a plurality of electrically insulating layers by resorting to a vapor phase method such as sputtering or the like method by using masks of predetermined patterns for thereby forming plural sets of coils turning substantially around a common axis, which method comprises a first step of forming an electrically insulating layer over a substrate, a second step of forming plural sets of electrically conductive strips in such a manner that at least two of the plural sets of the electrically conductive strips form coils wound in the directions opposite to each other, a third step of forming an electrically insulating layer in such a pattern that terminal end portions of the electrically conductive strips formed at the second step are left exposed, a fourth step of forming on the electrically insulating layer formed at the third step second plural sets of electrically conductive strips having start end portions connected to the corresponding terminal end portions of the first mentioned plural sets of the electrically conductive strips formed at the second step, and a fifth step of repeating the second no fourth steps a desired number of times, wherein at least two sets of coils wound in the directions opposite to each other are mutually interconnected at portions located closest to each other at one of the first, intermediate and final layer stacking steps.

In conjunction with the manufacturing methods described above, it should be added that a miniaturized stacked-layer transformer with an intermediate tap or taps can be implemented by forming a lead-out conductor or conductors at the intermediate step or steps mentioned above. More specifically, the intermediate or center tap can be formed by connecting start or terminal end portions of a primary coil winding and a secondary coil winding which are printed with turns of the directions opposite to each other, whereon the connection is lead outwardly to a peripheral location of the magnetic layer. Besides, according to the teachings of the invention, it is possible to realize a bifilar coil in a miniaturized size for a given value of inductance or alternatively to increase the inductance for a given size of the bifilar coil.

The above and other objects, features and attendant advantages of the present invention will be more clearly understood by reading the following description taken in conjunction with exemplary embodiments thereof by reference to the accompanying drawings.

BRIEF DESCRIPTION OF THE DRAWINGS

FIGS. 1(*b*) to 26(*b*) are sectional views corresponding to FIGS. 1(*a*) to 26(*a*), respectively, for illustrating the same manufacturing process;

FIGS. 28(*b*) to 62(*b*) are sectional views corresponding to FIGS. 28(*a*) to 62(*a*), respectively, for illustrating the same manufacturing method;

FIG. 83(*b*) to 96(*b*) are sectional views coresponding to FIGS. 83(*a*) to 96(*a*), respectively;

DESCRIPTION OF THE PREFERRED EMBODIMENTS

Now, the present invention will be described in detail in conjunction with preferred or exemplary embodiments thereof.

Figure 1:
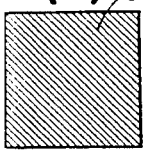
FIGS. 1(*a*) to 26(*a*) are plan views for illustrating a process of manufacturing a composite winding type stacked-layer inductor according to an exemplary embodiment of the present invention.

FIGS. 1(*a*) to 26(*a*) are plan views for illustrating steps involved in a method or process for manufacturing a composite winding type stacked-layer inductor according to a first embodiment of the present invention with FIGS. 1(*b*) to 26(*b*) showing the process in schematic sectional views correspondingly. Similarly, FIGS. 28(*a*) and (*b*) to FIGS. 63(*a*) and (*b*) illustrate a manufacturing method of the composite winding type stacked-layer inductor according to a second exemplary embodiment of the invention. In the case of the embodiments shown in FIGS. 1 to 26 and FIGS. 28 to 63, each of the composite winding type stacked-layer inductors is assumed to be constituted by two sets of coil winding conductor strips stacked in the directions opposite to each other. In contrast, in the case of the composite winding type stacked-layer inductor manufactured by the process according to a third embodiment illustrated in FIGS. 64 to 82, two sets of the conductor strips (having turns in a same direction assumed to be in the clockwise direction) and two sets of the conductor strips (having turns of the other direction which is assumed to be the counterclockwise direction) are stacked to thereby form a composite winding type stacked-layer inductor incorporating in total four sets of the coil winding forming conductor strips. In any of the exemplary embodiments, the coil winding forming conductor strips turn around at least approximately a common axis.

In the following, description will be made in detail of the first and second exemplary embodiments of the invention on the assumption that a single composite winding type stacked-layer inductor is to be formed on a delamination-easy substrate for convenience of the description, although it is commonly practiced to form simultaneously a plurality of such inductors on the single substrate. Further, in the following description, it is assumed that the layer stacking process is carried out by resorting to a printing method per se known heretofore, being understood that the layer stacking deposition can equally be realized by making use of other thin film techniques such as a sputtering method, an evaporation method or the like. Additionally, the following description of the preferred embodiments of the invention is directed to the layer stacking patterns for the composite winding type stacked-layer inductor having two or four sets of coil winding forming conductor strips. It should however be appreciated that the invention is never limited to such embodiments but intended to encompass any composite winding type stacked-layer inductors having plural sets of the coil winding forming conductor strips in which at least two sets of the conductor strips are stacked in the directions opposite to each other. The coil winding forming conductor strips my be of any electrically conductive material known heretofore. Equally, the magnetic layer maybe formed of any magnetic material known in the art. In more concrete, the conductor strip may be formed of a paste material containing pulverized Ag (silver), Au (gold), Cu (copper), Pd (palladium), Ag-Pd (silver-palladium) alloy and/or the like which is mixedly kneaded with an appropriate binder. Of course, any other electrically conductive pastes may be used, if suitable. In case the evaporation process is to be employed, the conductor material may be any one of Al, Ni, Cr-Au and others. As the material for the magnetic layer there may be mentioned Zn ferrite, Mn-Zn ferrite, Ni-Cu-Zn ferrite, $Fe_2O$ ferrite or the like magnetic material or a magnetic member coated with an electrically insulating material such as a dielectric material or a magnetic material as occasion requires. As the material for the electrically insulating layer, there may be used selectively a glass layers, an alumina layer, a barium titanate layer, a titanium oxide layer or the like.

It should further be mentioned that the composite winding type stacked-layer inductor according to the present invention can be incorporated integrally or discretely in a hybrid circuit including resistors, capacitors, transistors, diodes and/or others.

Exemplary Embodiment 1

Now, a method of manufacturing a composite winding type stacked-layer inductor according to a first exemplary embodiment of the present invention will be described in detail by reference to FIGS. 1 to 26, in which the figures labeled with (a) show plan views while those labeled with (b) show sectional views.

Figure 2:
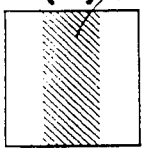
Figure 3:
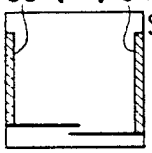
Figure 4:
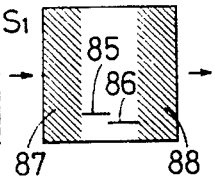
Figure 5:
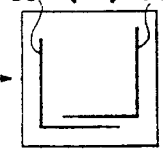
Figure 6:
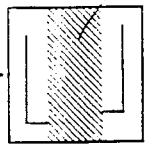
Figure 1:
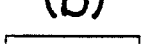
Figure 2:
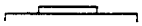
Figure 3:
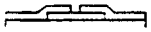
Figure 4:
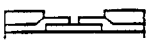
Figure 5:
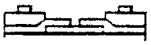
Figure 6:
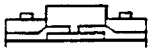
Figure 7:
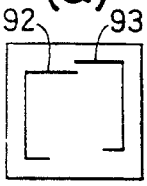
Figure 8:
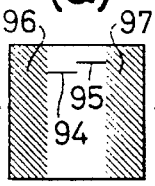
Figure 9:
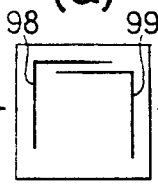
Figure 10:
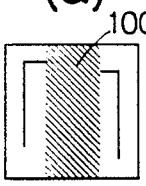
Figure 11:
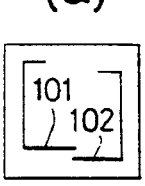
Figure 12:
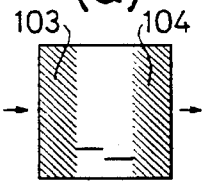
Figure 7:
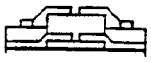
Figure 8:
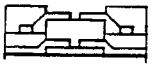
Figure 9:
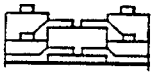
Figure 10:
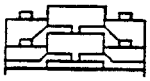
Figure 11:
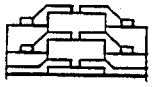
Figure 12:
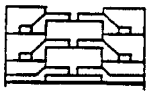
Figure 13:
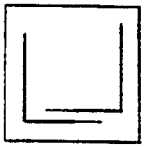
Figure 14:
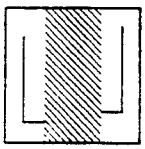
Figure 15:
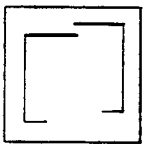
Figure 16:
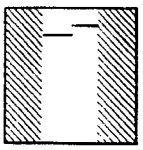
Figure 17:
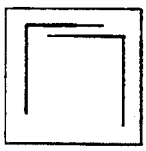
Figure 18:
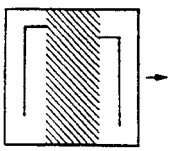
Figure 13:
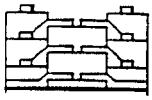
Figure 14:
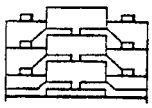
Figure 15:
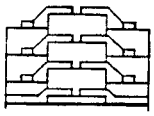
Figure 16:
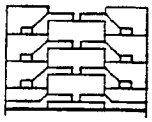
Figure 17:
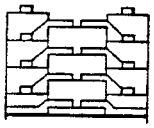
Figure 18:
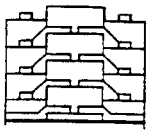
Figures 25, 26:
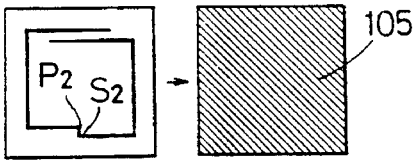
Figures 25, 26:
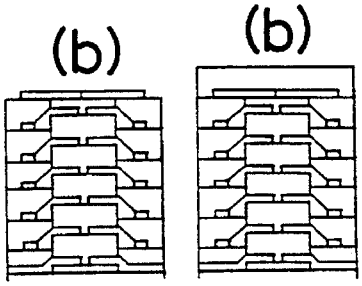
Figure 27:
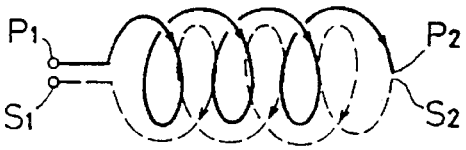
FIG. 27 shows an equivalent circuit diagram of the composite winding type stacked-layer inductor manufactured by the method illustrated in FIGS. 1(*a*) to 26(*a*) and FIGS. 1(*b*) to 26(*b*)

Referring to FIGS. 1(*a*) and 1(*b*), a magnetic layer 8i is printed over a whole surface of an easily detachable or separable (i.e. delamination-easy) substrate (not shown). Next, a magnetic layer 82 is deposited by printing for compensating for offset (non-uniformity in thickness) which would otherwise make apearance as the result of the layer deposition process, in a pattern as illustrated in FIGS. 2(*a*) and 2(*b*). Subsequently, a pair of electrically conductive strips (hereeinafter also referred to as the conductor strips) 83 and 84 for leading out coil winding are deposited by printing substantially symmetrially to each other in a telescopic pattern, as can be seen in FIGS. 3(*a*) and 3(*b*). It is preferred that these conductor strips be each of a length corresponding to about a quarter (¼) turn. Same holds true for the electrical conductor strips mentioned below. Next, magnetic layer sections 87 and 88 are printed over lefthand and righthand regions, respectively, in such a pattern that end portions 85 and 86 of the conductor strips 83 and 84 are left exposed, as can be seen in FIGS. 4(*a*) and 4(*b*). These magnetic layers 87 and 88 should preferably be so printed as to be complementary in shape to the magnetic layer 82 shown in FIGS. 2(*a*) and 2(*b*). Further, each of the magnetic layers 87 and 88 should preferably have a thickness smaller than that of the corresponding magnetic layers of the prior art inductor described hereinbefore and more preferably have a thickness corresponding to about a half of the latter. Same applies valid for the magnetic layers described below. Next, electrical conductor strips 90 and 89 for forming parts of the windings of the composite winding type stacked-layer inductor are deposited by printing symmetrically to each other in a telescopic pattern so as to be connected to the exposed end portions 85 and 86 of the conductor strips 83 and 84, respectively, as shown in FIGS. 5(*a*) and 5(*b*). In succession, a magnetic layer 91 is printed substantially at a mid or center region with vertical leg portions of the electrical conductor strips 90 and 89 being left exposed, as shown in FIGS. 6(*a*) and 6(*b*). Next, electrical conductor strips 92 and 93 are printed with a mutual deviation in electrical contact with the leg portions of the electrical conductor strips 89 and 90, respectively, as shown in FIGS. 7(*a*) and 7(*b*). Next, magnetic layers 96 and 97, are printed on the lefthand and righthand regions, respectively, so that the end portions of the conductor strips 92 and 93 are left exposed, as can be seen in FIGS. 8(*a*) and 8(*b*). Then, electrical conductor strips 98 and 99 are formed by printing in a telescopic pattern symmetrically to each other in contact with the exposed end portions 94 and 95 of the conductor strips 92 and 93, respectively, as shown in FIGS. 9(*a*) and 9(*b*). Next, a magnetic layer 100 is printed substantially at a center region with vertical leg portions 98 and 99 of the conductor strips 98 and 99 being left exposed, as shown in FIGS. 10(*a*) and 10(*b*). Subsequently, a pair of electric conductor strips 101 and 102 are printed with a deviation from each other and in electrical contact with the vertical leg portions of the conductor strips 98 and 99, respectively, as shown in FIGS. 11(*a*) and 11(*b*). The layer stacking steps described above by reference to FIGS. 4 to 11 are repeated in the processing steps illustrated in FIGS. 12 to 19 and FIGS. 20 to respectively. It will be self-explanatory that a desired number of turns for the coil winding can be realized by repeating the similar layer stacking process for a corresponding number of times. After completion of the layer stacking process for realizing the desired number of turns for the windings, then a layer stacking step shown in FIG. 25 is carried out, whereby terminal end portions $P_2$ and $S_2$ of a coil winding forming conductor extending between points $P_1$ and $P_2$ and a coil winding forming conductor extending between points $S_1$ and $S_2$ are connected to each other, and finally a magnetic layer 105 is printed over the whole surface. The layer-stacked structure is then sintered within a firing furnace, being followed by formation of terminals $P_1$ and $S_1$ for external connection and then by baking. Thus, there can be implemented a composite winding type stacked-layer inductor according to the first exemplary embodiment of the present invention. FIG. 27 shows an equivalent circuit diagram of this inductor.

Exemplary Embodiment 2

Next, a method of manufacturing a composite-winding type stacked-layer inductor according to a second exemplary embodiment of the invention will be described by reference to FIGS. 28 to 62, in which the figures labeled with (a) show plan views while those labeled with (b) show sectional views.

Figures 28, 29, 30, 31, 32, 33:
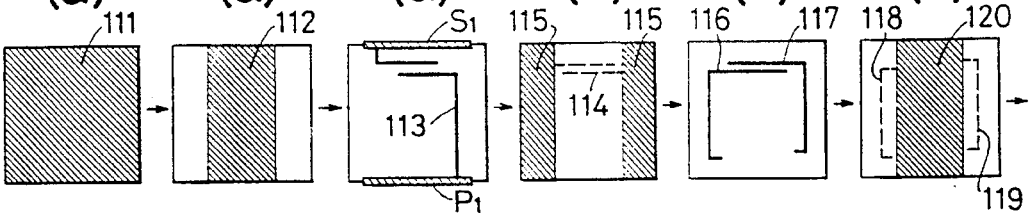
FIGS. 28(*a*) to 62(*a*) are plan views for illustrating a process of manufacturing the composite winding type stacked-layer inductor according to another exemplary embodiment of the invention.
Figures 28, 29, 30, 31, 32, 33:
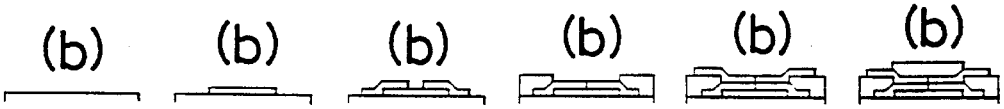
Figures 34, 35, 36, 37, 38, 39:
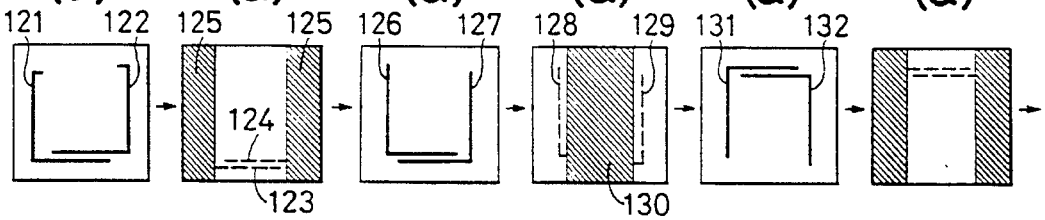
Figures 34, 35, 36, 37, 38, 39:
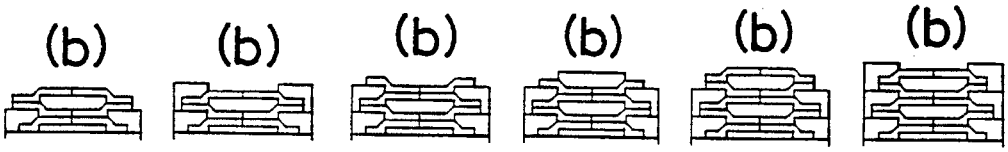
Figures 40, 41, 42, 43, 44, 45:
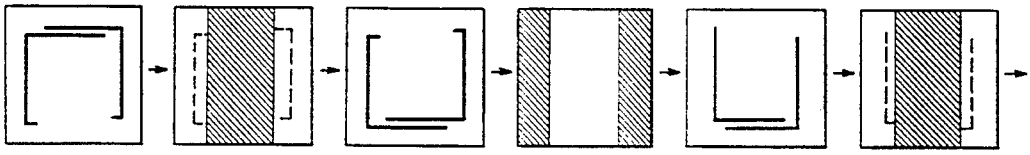
Figures 40, 41, 42, 43, 44, 45:
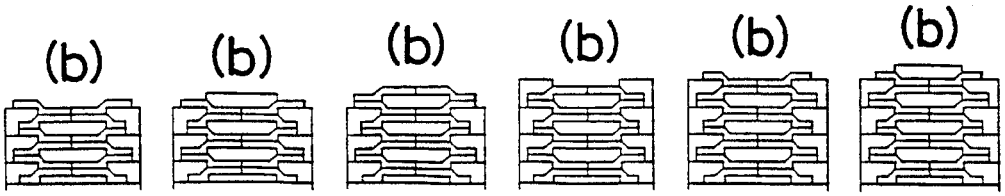
Figures 46, 47, 48, 49, 50, 51:
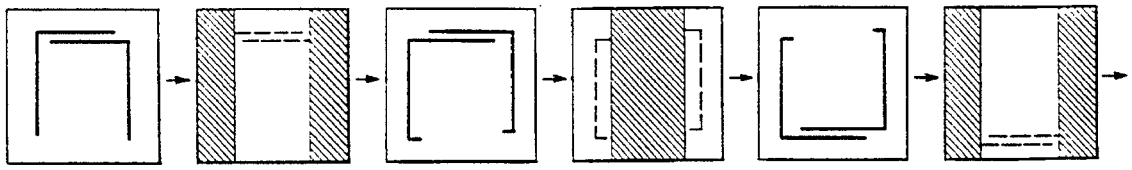
Figures 46, 47, 48, 49, 50, 51:
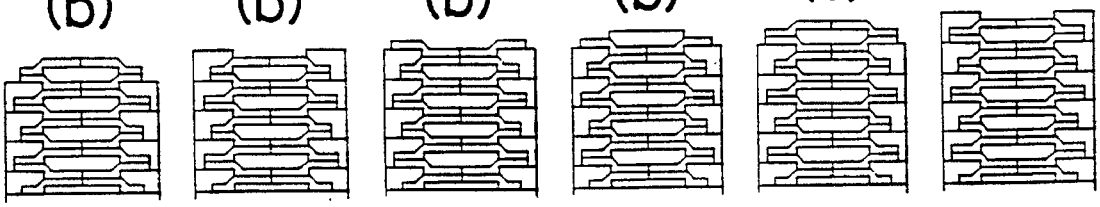
Figures 52, 53, 54, 55, 56, 57:
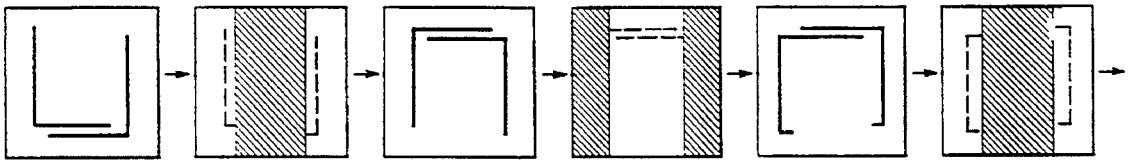
Figures 52, 53, 54, 55, 56, 57:
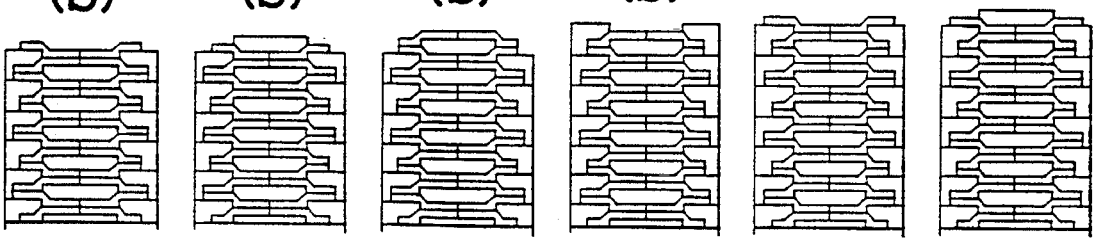
Figures 58, 59, 60, 61, 62:
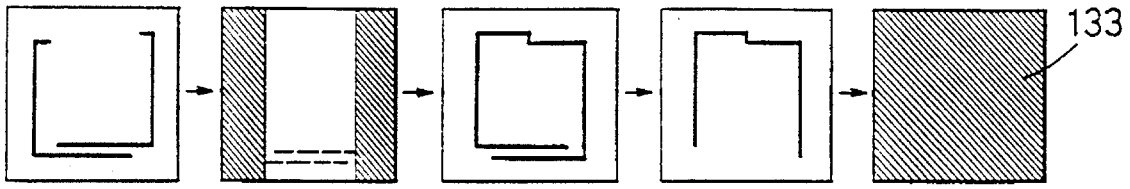
Figures 58, 59, 60, 61, 62:
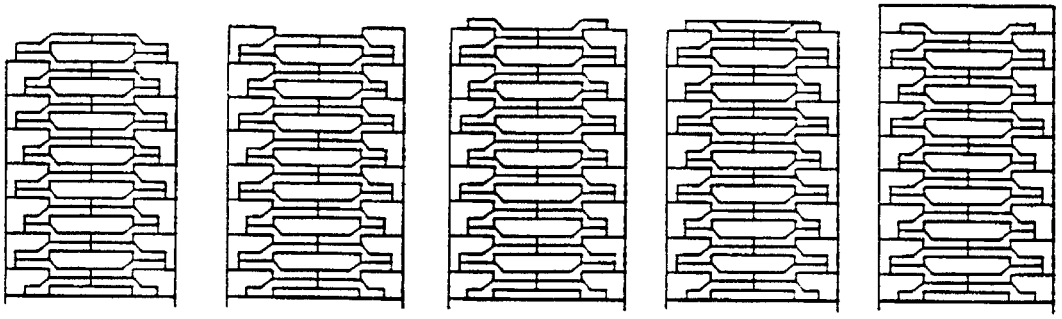
Figure 63:
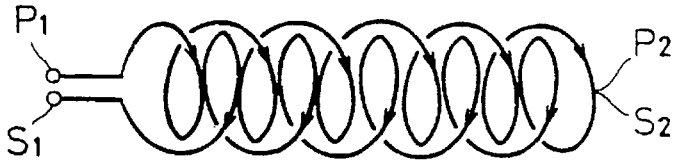
FIG. 63 shows an equivalent circuit diagram of the composite winding type stacked-layer inductor manufactured by the method illustrated in FIGS. 28(*a*) to 62(*a*) and FIGS. 28(*b*) to 62(*b*)

Referring to FIGS. 28(*a*) and 28(*b*), a magnetic layer 111 is deposided over a whole surface of an easily separable or delamination-easy substrate (not shown) by printing. Next, a magnetic layer 112 is printed for compensating for offset which would otherwise be resulted from the printing process, as shown in FIGS. 29(*a*) and 29(*b*). Subsequently, a pair of electrical conductor strips $S_1$ and $P_1$ for leading out coil windings are formed by printing at a top region and a bottom region, respectively, whereon an electric conductor strip 113 is printed in electrical contact with the conductor strip $P_1$, as can be seen in FIGS. 30(*a*) and 30(*b*). It is preferred that the electrical conductor strip 113 should be of a length corresponding to about a quarter (¼) turn, as in the case of the first embodiment 1 described hereinabove. Same holds true for the electrical conductor strips mentioned below. It should be noted that the conductor strip 113 is so printed as not to be connected to the conductor strip $S_1$. Next, magnetic layers 115 are printed on righthand and lefthand regions, respectively, so that a portion of the conductor strip 114 and an end portion of the conductor strip $S_1$ are left exposed, as can be seen in FIGS. 31(*a*) and 31(*b*). These magnetic layers 115 should preferably be so printed as to be complementary in shape to the magnetic layer 112, as shown in FIGS. 29(*a*) and 29(*b*). Further, each of the magnetic layers 115 should preferably have a thickness smaller than that of the corresponding magnetic layers of the prior art inductor described hereinbefore and more preferably have a thickness corresponding to about a half of the latter. Same applies true to the magnetic layers mentioned below. Next, an electrical conductor strips 116 for forming a part of a winding of the composite winding type stacked-layer inductor is so printed as to be connected to the exposed end portion 114 of the conductor strip 113, as shown in FIGS. 32(*a*) and 32(*b*). At the same time, an electric conductor strip 117 for forming a part of the other coil winding is printed in the direction opposite to that of the conductor strip 116 in a telescopic pattern and so extended as to be connected to the electric conductor strip $S_1$. Next, a magnetic layer 120 is printed substantially at a center region with the end portions 118 and 119 of the electrical conductor strips 116 and 117 being left exposed, as shown in FIGS. 33(*a*) and 33(*b*). Next, electrical conductor strips 121 and 122 are printed in electrical contact with the end portions 118 and 119 of the electrical conductor strips 116 and 117, respectively, in a telescopic pattern, as shown in FIGS. 34(*a*) and 34(*b*). Then, magnetic layers 125 are printed on righthand and lefthand regions, respectively, so that the end portions 123 and 124 of the conductor strips 121 and 122 are left exposed, as shown in FIGS. 35(*a*) and 35(*b*). Thereafter, electrical conductor strips 127 and 126 for forming parts of the coil windings are printed in a telescopic pattern symmetrically to each other in electrical contact with the exposed end portions 123 and 124 of the conductor strips 121 and 122, respectively. Next, a magnetic layer 130 is printed substantially on a center region with end portions 128 and 129 of the conductor strips 126 and 127 being left exposed, as shown in FIGS. 37(*a*) and 37(*b*). Subsequently, a pair of electric conductor strips 131 and 132 for forming parts of the coil windings are printed in a telescopic pattern in electrical contact with the end portions 128 and 129 of the conductor strips 126 and 127, respectively, as shown in FIGS. 38(*a*) and 38(*b*). The layer stacking steps described above by reference to FIGS. 31 to 38 are also repeated in the processes illustrated in FIGS. 39 to 46 and FIGS. 47 to 54 and FIGS. 55 to 59 , respectively. It is self-explanatory that a desired number of turns for the coil windings can be realized by repeating the similar layer stacking processes a corresponding number of times. After completion of the layer stacking processes for realizing the desired number of turns for the windings, then a layer stacking step shown in FIG. 60 is carried out, whereby terminal end portions $P_2$ and $S_2$ of a coil winding forming conductor extending between points $P_1$ and $P_2$ and a coil winding forming conductor extending between points $S_l$ and $S_2$ are connected to each other. Next, the terminal-connection similar to that shown in FIG. 60 is formed, as occasion requires. Finally a magnetic layer 133 is printed over the whole surface. The layer-stacked structure is then sintered within a firing furnace, being followed by formation of the terminals $P_1$ and $S_1$ for external connection and then by baking. Thus, there can be implemented a composite winding type stacked-layer inductor according to the first exemplary embodiment of the present invention. FIG. 63 shows an equivalent circuit diagram of this stacked-layer inductor.

Exemplary Embodiment 3

FIGS. 64 to 81 are plan views for illustrating a manufacturing method of a composite winding type stacked-layer inductor including four sets of electric conductor strips for forming the coil windings according to a third exemplary embodiment of the invention.

Figure 64:
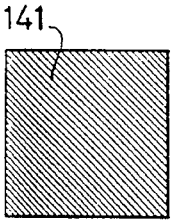
FIGS. 64 to 81 are plan views for illustrating steps involved in a process for manufacturing the composite winding type stacked-layer inductor according to still another embodiment of the invention.
Figure 65:
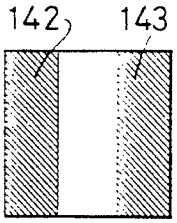
Figure 66:
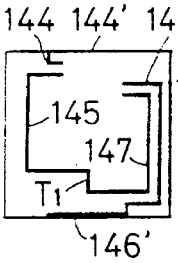
Figure 67:
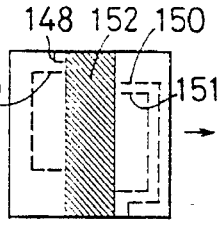
Figure 68:
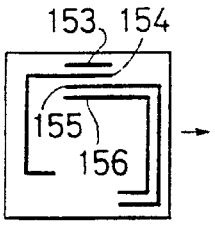
Figure 69:
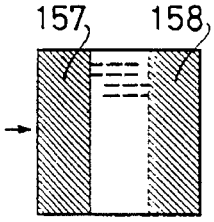
Figure 70:
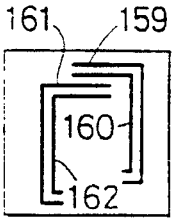
Figure 71:
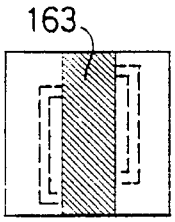
Figure 72:
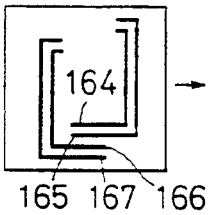
Figure 73:
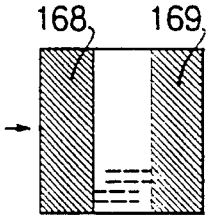
Figure 74:
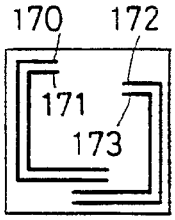
Figure 75:
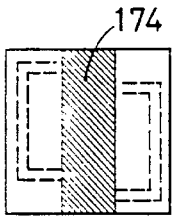
Figure 76:
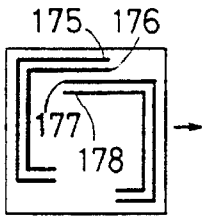
Figure 77:
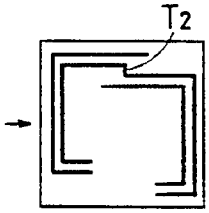
Figure 78:
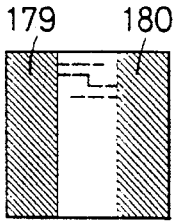
Figure 79:
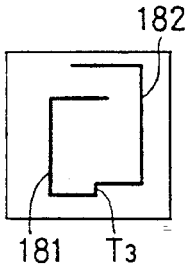
Figure 80:
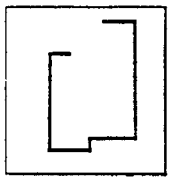
Figure 81:
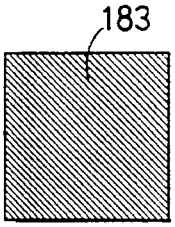
Figure 82:
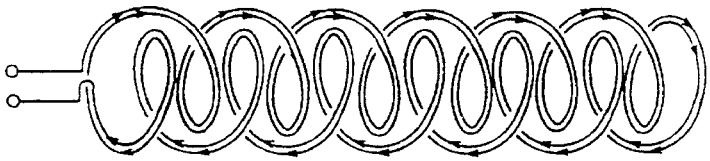
FIG. 82 shows an equivalent circuit diagram of the composite winding type stacked-layer inductor manufactured by the process illustrated in FIGS. 64 to 81.
Figures 83, 84, 85, 86, 87, 88:
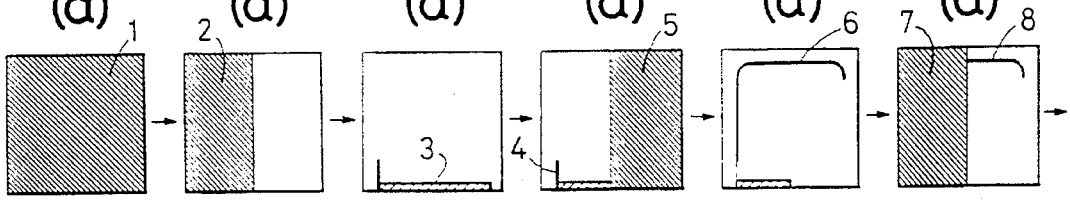
Prior Art FIG.83 (a) FIG.84 (a) FIG.85 (a) FIG.86 (a) FIG.87 (a) FIG.88 (a)
FIGS. 83(*a*) to 96(*a*) are plan views for illustrating a process for manufacturing a prior art stacked-layer inductor.
Figures 83, 84, 85, 86, 87, 88:
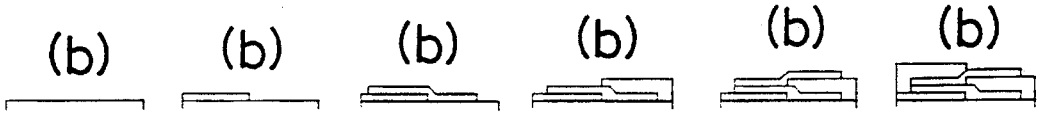
Figures 89, 90, 91, 92, 93, 94:
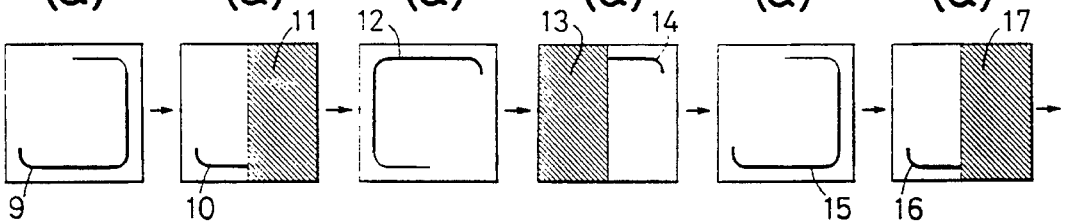
Figures 89, 90, 91, 92, 93, 94:
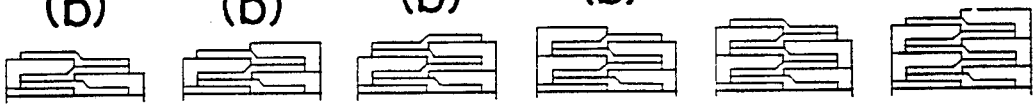
Figures 95, 96:
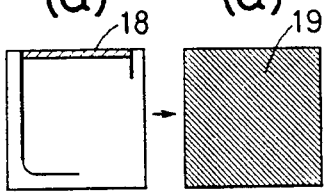
Figure 97:
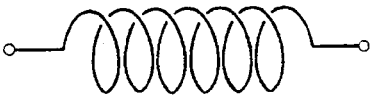
FIG. 97 shows an equivalent circuit diagram of the prior art stacked-layer inductor manufactured by the process illustrated FIGS. 83 to 96.
Figures 95, 96:
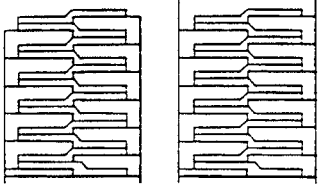
Figure 98:
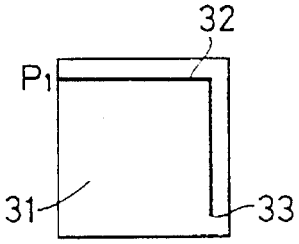
Prior Art FIG.98
FIGS. 98 to 105 are plan views for illustrating steps involved in a process for manufacturing a prior art stacked-layer transformer.
Figure 99:
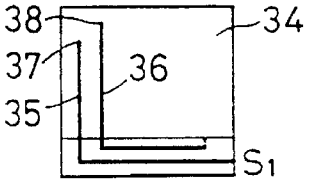
Figure 100:
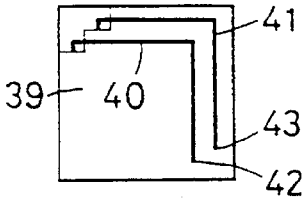
Figure 101:
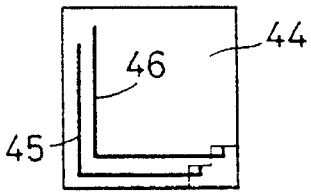
Figure 102:
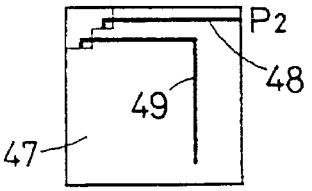
Figure 103:
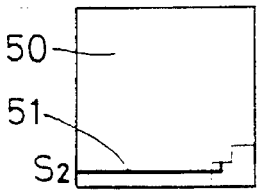
Figure 104:
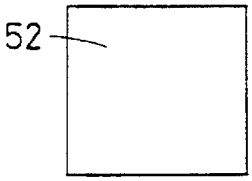
Figure 105:
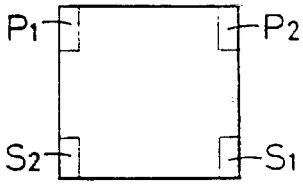
Figure 106:
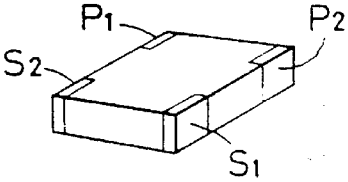
FIG. 106 shows a perspective view of a conventional stacked-layer transformer.
Figure 107:
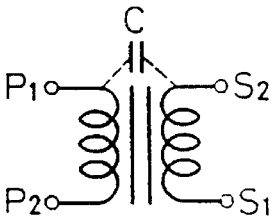
FIG. 107 shows an equivalent circuit diagram of the stacked-layer transformer manufactured by the method illustrated in FIGS. 98 to 105.
Figure 108:
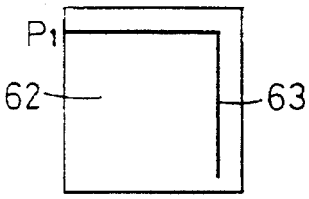
Prior Art FIG.108
FIGS. 108 to 112 are plan views showing steps involved in a method of manufacturing a further stacked-layer transformer known theretofore.
Figure 109:
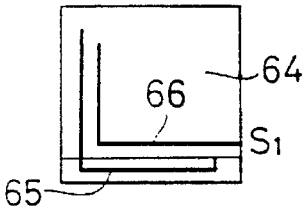
Figure 110:
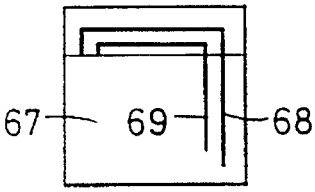
Figure 111:
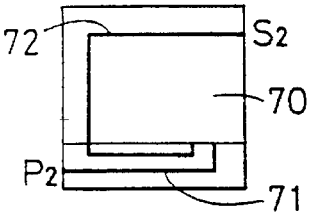
Figure 112:
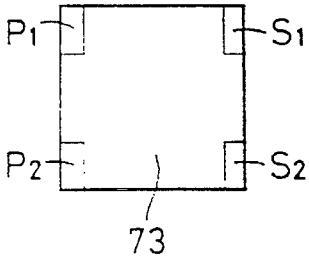

Referring to FIG. 64, a magnetic layer 141 is printed over a whole surface of an easily detachable substrate (not shown). Next, magnetic layers 142 and 143 are printed on lefthand and righthand regions for compassating for the print offset mentioned hereinbefore, as shown in FIG. 65 . Subsequently, a first set of conductor strips 144 for forming coil windings (which is assumed to be wound clockwise) and having a lead-out portion 144' is printed along the top side, a second set of electric conductor strips 145 for forming coil windings (which is assumed to be wound clockwise) are printed along the left side, a third set of electric conductor strips 147 for forming coil winding (wound counterclockwise) is printed along the right side, and a fourth set of conductor strips for forming coil windings (wound counterclockwise) is also printed along the right side and the bottom side to thereby form a lead-out portion 146', as shown in FIG. 66. Next, the second set of the electric conductor strips 145 of the clockwise turns and the third set of the electric conductor strips 147 of the counterclockwise turns are connected to each other by a connecting conductor strip $T_1$. This connecting conductor strip $T_1$ as well as the connecting conductor strips $T_2$ and $T_3$ described hereinafter are required in order that the four coil windings constituted by two sets of the conductor strips wound in the same direction, respectively, form the two closed loops. Then, in FIG. 67, a magnetic layer 152 is printed substantially on a center region so that there are left exposed an end portion 148 of the conductor strip 144, an end portion 149 of the conductor strip 145, an end portion 151 of the conductor strip 147 and an end portion 150 of the conductor strip 146, respectively. The magnetic layer 152 should preferably be so printed as to have a shape complementary to those of the magnetic layers 142 and 143 printed in precedence. Same holds true for the similar magnetic layers described hereinafter. The complementary thickness is about half of that of the other magnetic layers. Next, a conductor strip 153 for the clockwise turn is printed in electrical contact with the end portion 148 of the conductor strip 144, a conductor strip 154 for the counterclockwise turn is printed in electrical contact with the end portion 149 of the conductor strip 145, a conductor strip 155 for the counter clockwise turn is printed in electrical contact with the end portion 150 of the conductor strip 146, and a conductor strips 156 for the counterclock-wise turn is printed in electrical contact with the end portion 151 of the conductor strip 147, respectively, as can be seen in FIG. 68. Next, magnetic layers 157 and 158 are printed on the lefthand and righthand regions, respectively, in such disposition that portions of the conductor strips 153 , 154, 155 and 156 are left exposed, respectively, as shown in FIG. 69. Then, electric conductor strips 159 and 160 are printed so as to extend in the clockwise direction from the connections with the conductor strips 153 and 154, respectively, as shown in FIG. 70. Similarly, conductor strips 161 and 162 are printed so as to extend counterclockwise from the connections with the conductor strips 155 and 156, respectively. Each of the conductor strips 159 to 162 should preferably be of a length which corresponds to about a quarter turn. Next, a magnetic layer 163 is printed substantially on a center region so that the conductor strips 159 to 162 are partially exposed; as shown in FIG. 71. Next, conductor strips 164 and 165 are so printed as to be connected to the conductor strips 160 and 159, respectively, and extend to the left, while electric conductor strips 166 and 167 are so printed that they are connected to the conductor strips 162 and 161, respectively, and extend rightwards, as shown in FIG. 72. Next, magnetic layers 168 and 169 are printed on left and right regions, respectively, with the conductor strips 164 to 167 being left partially exposed, as shown in FIG. 73. Further, electric conductor strips 170 and 171 each of which should preferably be of a length corresponding to about a quarter turn are so printed as to be connected to the conductor strips 165 and 164, respectively, and extend therefrom in the clockwise direction, as shown in FIG. 74. Besides, conductor strips L72 and 173 each of which should preferably of a length corresponding to about a quarter turn are so printed as to be connected to the conductor strips 167 and 166, respectively, and extend therefrom in the direction counterclockwise. Next, a magnetic layer 174 is printed substantially on a center region so that the electric conductor strips 170 to 173 remain partially exposed, as shown in FIG. 75. Subsequently, electric conductor strips 175 and 176 are printed in such a pattern that they are connected to the conductor strips 170 and 171 and extend therefrom to the right, while the conductor strips 177 and 178 are so printed as to be connected to the conductor strips 172 and extend therefrom to the left, as shown in FIG. 76. It is apparent that the conductor strips for forming the coil winding having a desired number of turns can be printed by repeating a corresponding number of turns the layer stacking process described above in conjunction with FIGS. 69 to 76. When the layer stacking process has been repeated a desired number of times, a magnetic layer 174 is printed on a center or mid region as shown in FIG. 75, whereon the conductor strip 176 of the second set for forming the coil winding having the clockwise turns and the conductor strip 177 of the fourth set for forming the coil winding having the counterclockwise turns are connected by the connecting strip $T_2$, as shown in FIG. 77. Next, magnetic layers 179 and 180 are printed on left and right regions, respectively, with the conductor strips 175 and 178 being left exposed, as shown in FIG. 78. Thereafter, an electric conductor strip 181 preferably of a length corresponding to about a quarter turn is so printed as to be connected to the conductor strip 178 and extend therefrom counterclockwise, while at the same time a conductor strip 182 preferably of a length corresponding to about a quarter turn is so printed as to be connected to the conductor strip 175 and extend therefrom in the clockwise direction, whereon the conductor strip 182 of the first set for forming the coil winding having the clockwise turns and the conductor strip 181 of the second set for forming the coil winding having the counterclockwise turns are connected to each other by the connecting strip $T_3$ as shown in FIG. 80. If desired, the end connection similar to that shown in Fig, 79 can be realized, Then, a magnetic layer 183 is printed over substantially whole surface. The stacked layer structure is sintered within a firing furnace, After forming the terminals for external connection by baking, there is finished the composite winding type stacked-layer inductor which incorporates therein the four sets of the conductor strips for forming the four coil windings, respectively.

Exemplary Embodiment 4

This embodiment is concerned with a composite winding type stacked-layer inductor having a center or intermediate tap, The stacked-layer inductor now under consideration may be implemented starting from any one of the exemplary embodiments 1 to 3 described hereinbefore. For convenience of description, however, a method of manufacturing the composite winding type stacked layer inductor having a center or intermediate tap as well as a structure thereof will be described, starting from the exemplary embodiment 1 shown in FIGS. 1 to 26.

Figures 19, 20, 21, 22, 23, 24:
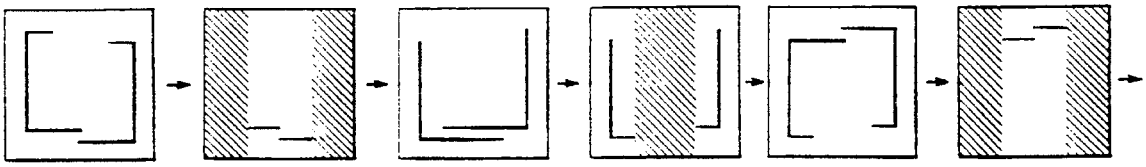
Figures 19, 20, 21, 22, 23, 24:
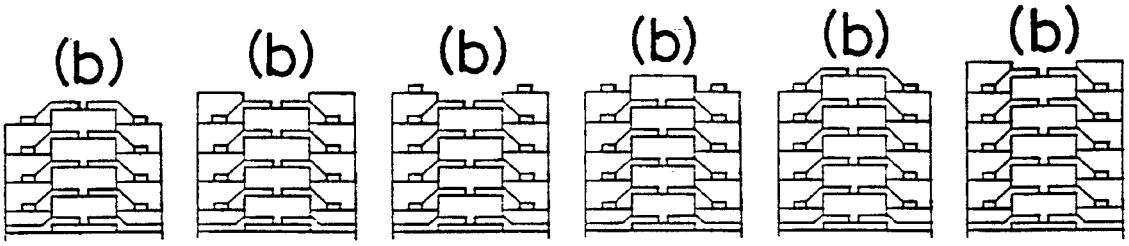
Figure 113:
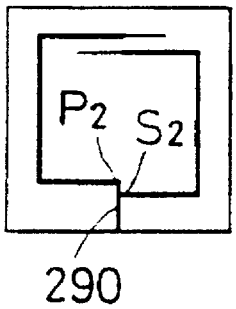
FIG. 113 is a plan view for illustrating a step involved in a process of manufacturing a stacked-layer transformer with an intermediate or center tap according to yet another embodiment of the present invention.
Figure 114:
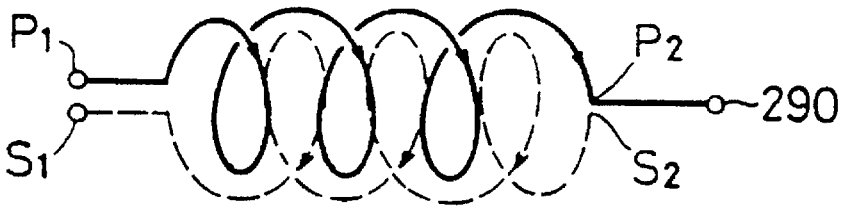
FIG. 114 is a view showing windings of the stacked-layer transformer with a center tap manufactured by the process including the step illustrated in FIG. 113.
Figure 115:
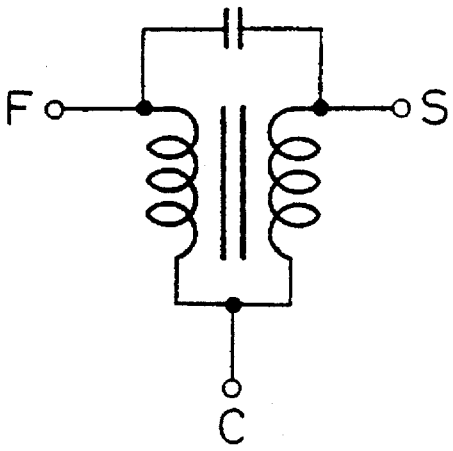
FIG. 115 is an equivalent circuit diagram of the stacked-layer transformer having a center or intermediate tap manufactured by the process including the step illustrated in FIG. 113.
Figure 116:
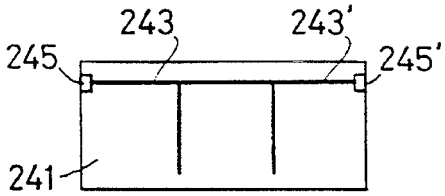
Prior Art FIG. 116
FIGS. 116 to 124 are plan views for illustrating step involved in a process for manufacturing a stacked-layer transformer with an intermediate or center tap known heretofore.
Figure 117:
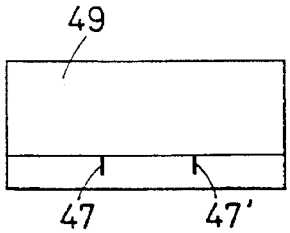
Figure 118:
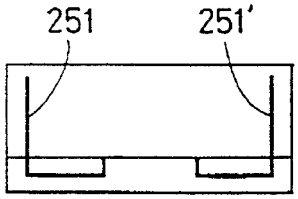
Figure 119:
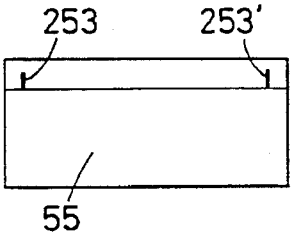
Figure 120:
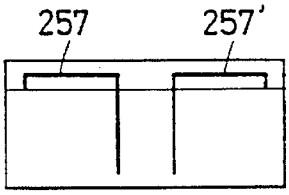
Figure 121:
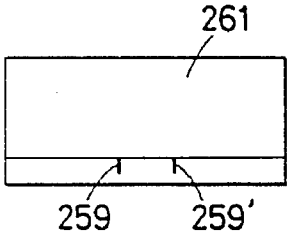
Figure 122:
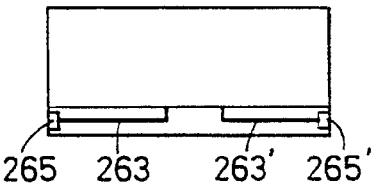
Figure 123:
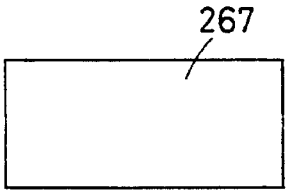
Figure 124:
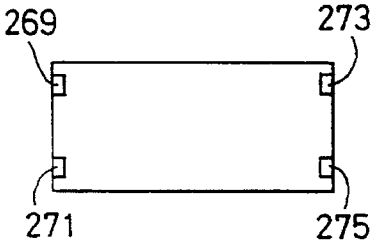
Figure 125:
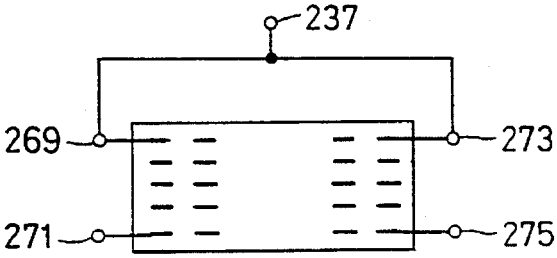
FIG. 125 is a schematic circuit diagram of the stacked-layer transformer with a tap manufactured the process illustrated in FIGS. 116 to 124.
Figure 126:
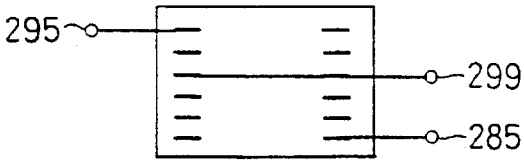
FIG. 126 Prior Art
FIG. 126 is a schematic diagram showing another stacked-layer transformer with a tap known heretofore.

More specifically, the manufacturing steps substantially corresponding to those shown in FIGS. 1 to 24 and FIG. 26 are followed in the case of the instant embodiment. However, the step shown in FIG. 25 is replaced by a step shown in FIG. 113 at which the terminal ends of the two winding conductors prepared through the process up to step shown in FIG. 24 are connected together, whereon a lead-out conductor 290 is printed. This conductor 290 is finally connected to an external terminal for the intermediate tap. FIG. 114 illustrates schematically a structure of this stacked-layer inductor with the center tap, wherein the tap is denoted by a numeral 290. Incidentally, in FIG. 114, reference character $P_1$ denotes a starting end of a primary coil winding, $P_2$ denotes a terminal end of the same, $S_1$ denotes a starting end of a secondary coil winding and $S_2$ denotes a terminal end of the same, wherein both the terminal ends are connected together to constitute the center or intermediate tap 290. FIG. 115 shows an equivalent circuit diagram of the inductor according to the instant embodiment. In the stacked-layer transformer with the center or intermediate tap described above, it is possible to increase or decrease the capacity distributed among the electrical conductor strips by printing the primary/secondary winding conductor strips with distances therebetween being varied appropriately. Needless to say, it is also possible to change arbitrarily the size, shape and other of the electrical conductor strips and the magnetic layers.

Exemplary Embodiment 5

FIGS. 127 to 160 are plan views showing stepwise a process for manufacturing a bifilar winding type stacked-layer transformer with a center or intermediate tap. In general, in the bifilar winding type stacked-layer transformer, it is conventionally practiced to realize simultaneously a plurality of the stacked-layer transformer on a single delamination-easy substrate. The following description is, however, directed to a single bifilar winding type stacked,layer transformer, by way of example only.

Now, referring to FIGS. 127 to 160, description will be made of a process for manufacturing a bifilar winding type stacked-layer transformer according to the fifth embodiment of the present invention.

Figure 127:
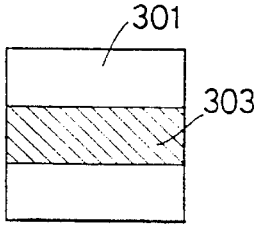
FIGS. 127 to 159 are plan views for illustrating steps involved in a process for manufacturing a bifilar winding type stacked-layer transformer according to a further embodiment of the present invention.
Figure 128:
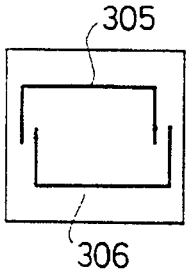
Figure 129:
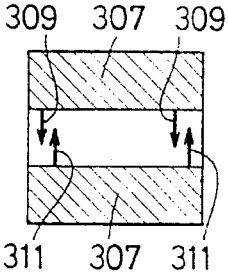
Figure 130:
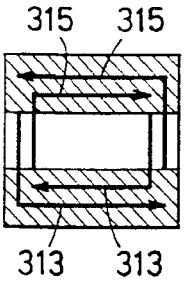
Figure 134:
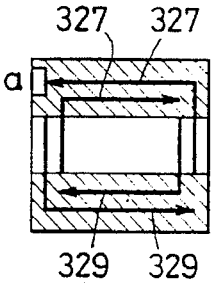
Figure 133:
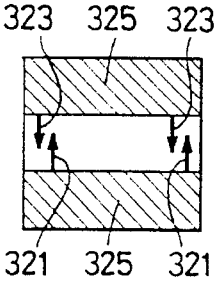
Figure 132:
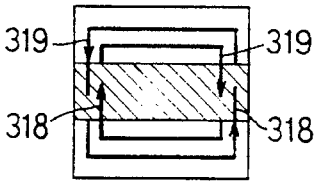
Figure 131:
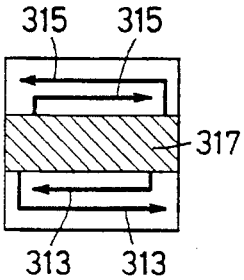
Figure 135:
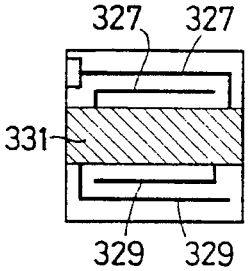
Figure 136:
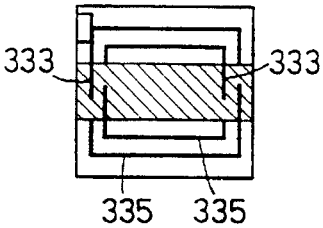
Figure 137:
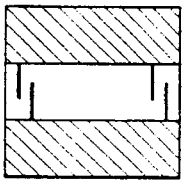
Figure 138:
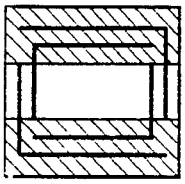
Figure 142:
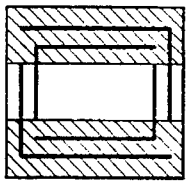
Figure 141:
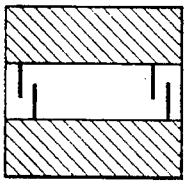
Figure 140:
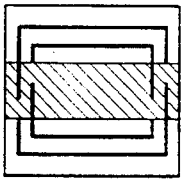
Figure 139:
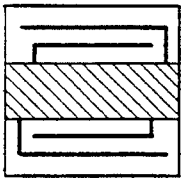
Figure 143:
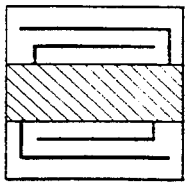
Figure 144:
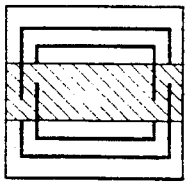
Figure 145:
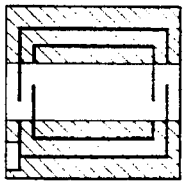
Figure 160:
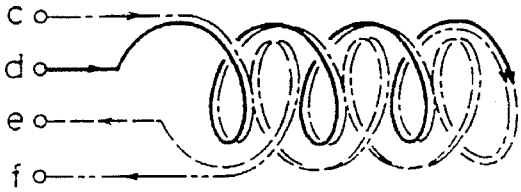
FIG. 160 is a schematic diagram showing windings of a bifilar winding type stacked-layer transformer having taps manufactured through the process illustrated in FIGS. 127 to 159.
Figure 161:
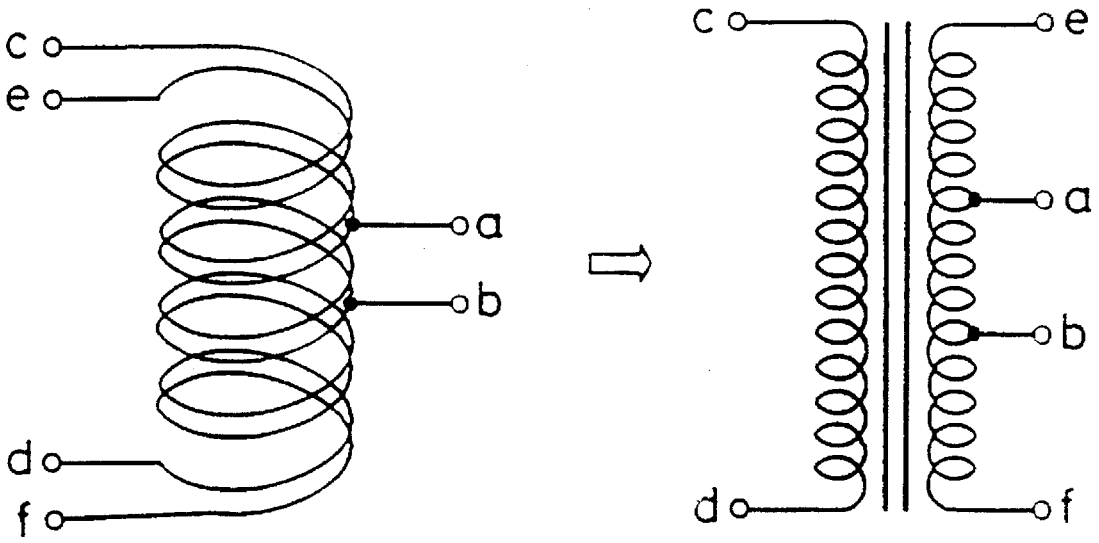
FIG. 161 shows an equivalent circuit diagram of a bifilar winding type stacked-layer transformer with a tap as manufactured through a modified one of the process illustrated in FIGS. 127 to 159.
Figure 162:
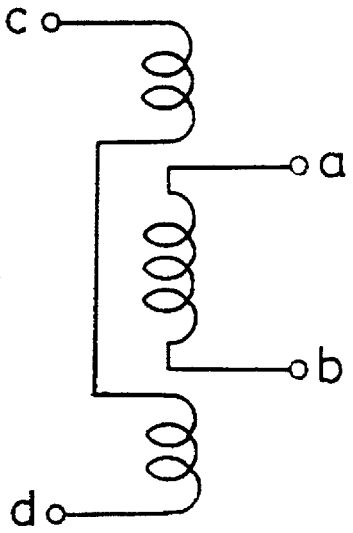
FIG. 162 shows an equivalent circuit diagram of a bifilar winding type stacked-layer transformer with a tap as manufactured through another modification of the process illustrated in FIGS. 127 to 159.
Figure 163:
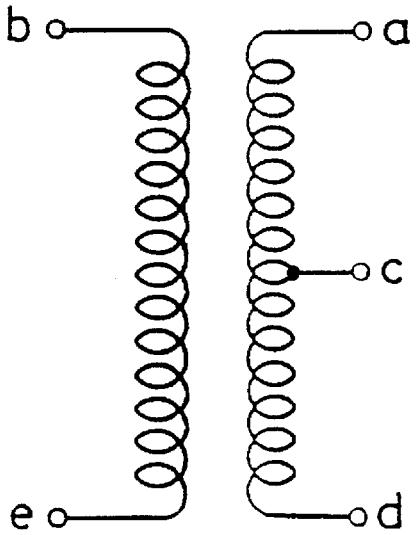
FIG. 163 shows an equivalent circuit diagram of a bifilar winding type stacked-layer transformer according to a still further embodiment of the present invention.

A magnetic layer 301 is printed over a whole surface of a delamination-easy substrate (not shown), being then followed by the step for printing a magnetic layer 303 substantially on a center region for compensation for the print offset mentioned hereinbefore, as shown in FIG. 127. Next, an electric conductor strip 306 for the primary coil winding (hereinafter referred to simply as the primary coil conductor strip) and an electric conductor strip 305 for the secondary coil winding (hereinafter referred to simply as the secondary coil conductor strip) are printed in a telescopic pattern so that they extend in the opposite directions around a common axis, as shown in FIG. 128. Each of the primary/secondary coil conductor strips should preferably be of a length corresponding to about a quarter turn. Same applies true for the conductor strips mentioned below. Next, magnetic layers 307 are printed in such a pattern that both end portions 311 of the primary coil conductor strip 306 and those 309 of the secondary coil conductor strip 305 are left exposed, as illustrated in FIG. 129. The magnetic layers 307 should preferably be so printed as to be complementary in shape to the magnetic layers 307. Subsequently, the end portions 311 of the primary coil conductor strip 306 and those 309 of the secondary coil conductor strip 305 are connected together, whereon the primary and secondary conductor strips 315 and 313 are printed in such a pattern as shown in FIG. 130. At a step shown in FIG. 131, a magnetic layer 317 is printed substantially on a center region so that the primary and secondary conductor strips 315 and 313 are left as being partially exposed. The magnetic layer 317 should preferably be printed in a shape complementary to those of the magnetic layers 307. The same applies valid for the corresponding magnetic layers mentioned in the following. Subsequently, at a step shown in FIG. 132, primary and secondary coil conductor strips 319 and 318 are so printed as to be electrically contacted to the primary and secondary coil conductor strips 315 and 313, respectively. At a next step shown in FIG. 133, magnetic layers 325 are printed in such a pattern that both end portions 323 and 321 of the primary and secondary coil conductor strips 319 and 318 are left exposed. Subsequently, the layer stacking process performed for the primary and secondary coil conductor strips 315 and 313 as described above in conjunction with FIGS. 130 to 133 is performed repeatedly a desired number of times by exchanging the primary and secondary coil conductor strips with each other and thus on the secondary and primary coil conductor strips 321 and 323 (refer to FIGS. 137 to 152). Thereafter, at a step shown in FIG. 153, magnetic layers 341 are printed in such a pattern that both end portion 339 and 337 of the primary and secondary conductor strips are left exposed. Next, at a step shown in FIG. 154, primary and secondary coil conductor strips 345 and 343 are printed in electrical contact with the end portions 339 and 373 of the primary and secondary conductor strips 327 and 323, respectively, whereon one of the primary coil conductor strips 345 is lead out to a side of the magnetic layer to thereby form a terminal lead-out portion (c) for the primary coil. Subsequently, at a step shown in FIG. 155, a magnetic layer 347 is printed substantially at a center region so that portions of the primary/secondary coil conductor strips 345 and 343 and a terminal lead-out portion (c) for the secondary coil are left exposed. At a step shown in FIG. 156, secondary coil conductor strips 349 are printed so as to be connected to portions of secondary coil conductor strips 343, respectively, while a primary coil conductor strip 351 is so printed as to be connected to one of the primary coil conductor strips 345. At a next step shown in FIG. 157, magnetic layers 357 are so printed that portions 353 of the secondary coil conductor strips 349 and a portion 355 of the primary coil conductor strip 351 are left exposed. Next, at a step-158, secondary coil conductor strips 361 are printed in electrical contact with portions 353 of the secondary coil conductor strips 349, respectively. The secondary coil conductor strips 361 are lead out to appropriate positions on a side of the magnetic layer. Additionally, a primary coil conductor strip 363 is printed in contact with a portion 355 of the primary coil conductor strip 351 and lead out to the side of the magnetic layer to thereby form a lead-out portion (d) for the primary coil terminal. At a step shown in FIG. 159, a magnetic layer 364 is printed, wherein the coil conductor strips 361 are lead out to peripheral locations (e) and (f), respectively. After printing a magnetic layer (not shown) over the whole surface, the terminals (c), (d), (e) and (f) as required are formed by coating and baking. Thus, there is realized a bifilar winding type stacked-layer transformer, as shown in FIG. 160.

Exemplary Embodiment 6

The description is directed to a modification of the bifilar winding type stacked-layer transformer with an intermediate or center tap described above as well as a manufacturing method thereof by reference to FIGS. 127 to 160.

Figure 146:
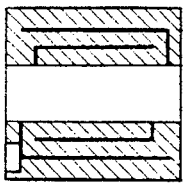
Figure 150:
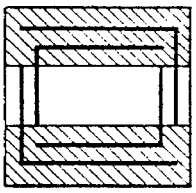
Figure 149:
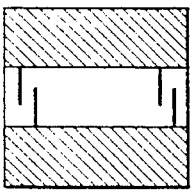
Figure 148:
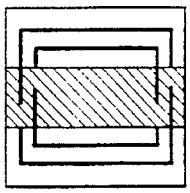
Figure 147:
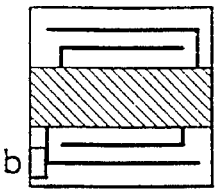
Figure 151:
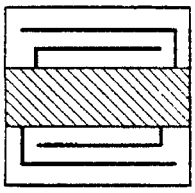
Figure 152:
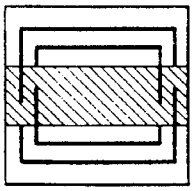
Figure 153:
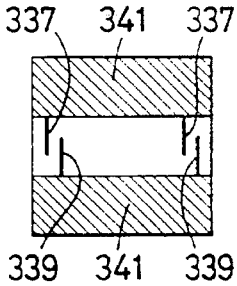
Figure 154:
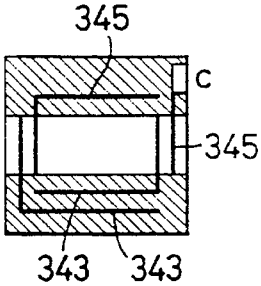
Figure 158:
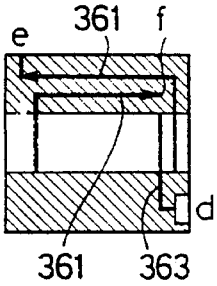
Figure 157:
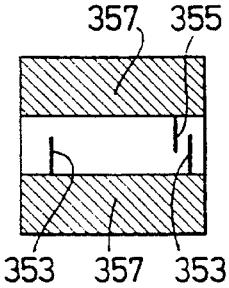
Figure 156:
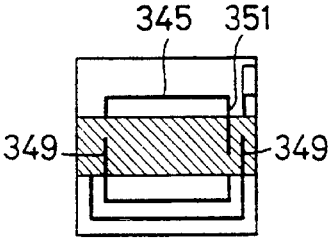
Figure 155:
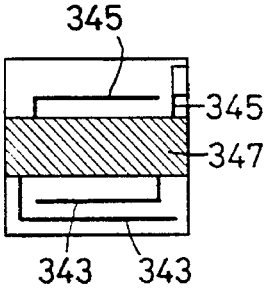
Figure 159:
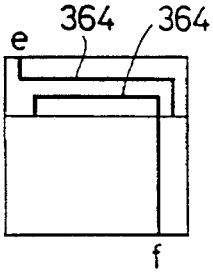

At steps shown in FIGS. 127 to 133, the layer stacking process is performed as in the case of the fifth embodiment described above. In succession, at a step shown in FIG. 134, primary and secondary coil conductor strips 329 and 327 are printed in contact with the primary and secondary coil conductor strips 319 and 318, respectively, whereon one of the secondary coil conductor strips 327 is lead out to a peripheral point on a side of the magnetic layer for thereby forming a lead-out part (a) for the center tap. Next, at a step shown in FIG. 135, a magnetic layer 331 is printed substantially at a center region so that portions of the primary and secondary coil conductor strips 329 and 327 and the center tap lead-out portion (a) are left exposed. Subsequently, at a step shown in FIG. 136, primary coil conductor strips 335 and secondary coil conductor strips 333 are printed so as to be connected to portions of the primary coil conductor strip 329 and the center tap lead-out portion (a), respectively. Then, primary and secondary coil conductor strips are stacked through the process steps similarly to those shown in FIGS. 137 to 145. When desired, the layer stacking step similar to that shown in FIG. 134 may be performed, as shown in FIG.146, to thereby form a center tap lead-out portion (b). Next, steps similar to those shown in FIGS. 147 to 159 are performed. Finally, the stacked-layer structure is sintered, whereon terminals (a), (b), (c), (d), (e) and (f) for external connections are provided by baking.

In the foregoing, a variety of exemplary embodiments of the composite winding type stacked-layer inductor according to the present invention have been described. It will readily be understood that capacity distributed among the electric conductor strips can be decreased by positioning correspondingly the strips upon printing thereof. Obviously, the size, shape and other geometrical factors of the conductor strips can be changed or altered, as desired or occasion requires.

The composite winding type stacked layer inductor manufactured through the steps shown in FIGS. 1 to 26 is attended with advantageous effects, which will be elucidated below. When the end portions $P_2$ and $S_2$ are finally connected together, as shown in FIG. 25, the coil winding formed by the conductor strips $P_1$–$P_2$ for the counterclockwise turns and the coil winding formed by the conductor strips $S_1$–$S_2$ for the clockwise turns through the steps shown in FIG. 1 to 7 constitute a coil winding turning in a predetermined same direction, whereby magnetic fluxes generated upon flowing of a current through the coil winding are oriented in the same direction, as the result of which there can be realized four times as high inductance as that of a hitherto known bifilar coil in which the magnetic fluxes are generated in the opposite directions. Similar advantageous effect can be obtained in the case of the inductor according to the second embodiment of the invention. Besides, the third embodiment described in conjunction with FIGS. 64 to 81 in which the four sets of the coil winding forming conductor strips are used can surprisingly exhibit sixteen times as high inductance as that of the conventional single-bifilar winding coil.

In case the thickness of the magnetic layer is decreased as compared with that of the prior art inductor and preferably to about a half of the latter, twice or four times as many turns of the winding as that of the prior art inductor (and hence four times or sixteen times as high inductance) can be realized with the thickness of the stacked-layer structure being maintained substantially equal to that of the prior art inductor.

In the foregoing, the present invention has been described in conjunction with several preferred embodiments. It should however be understood that numerous modifications and changes can readily occur to those skilled in the art without departing from the spirit and scope of the present invention. By way of example, although it has been described in conjunction with the preferred embodiments that the number of the coil winding sets incorporated in the inductor is given by two or four or an even number in general, it is apparent that such an inductor including plural sets of the coil windings in which at least two sets are connected in the directions opposite to each other is encompassed by the concept of the present invention. Further, it goes without saying that not only the inductor having the coil windings of opposite turn directions connected together at a start or terminal end but also the inductor having such coil winding connected together at an intermediate point falls within the purview of the present invention.

Further, according to the present invention, a stacked-layer transformer with a center or intermedioate tap or taps can readily be manufactured by simply attaching tapping leads. Also in this type transformer, advantages mentioned above can of course be obtained.

Even when a part of the magnetic material is replaced by a non-magnetic material, the transformer can be operated within a wide linear range in which the magnetic permeability $\mu$ bears a linear relation to the applied magnetic field intensity H, whereby the linearity characteristic of the transformer can be improve$_d$.

By printing the adjacent magnetic layers in the forms complementary to each other, stacked-layer transformers having a constant or uniform thickness can be realized.

It is also possible to reduce the capacity distributed among the conductor strips forming the coil windings by varying correspondingly the distance therebetween. Obviously, the size, shape and other geometrical factors of the conductor strip can be changed rather arbitrarily.

Thus, it should be appreciated that various modifications and changes can easily be resorted to by those skilled in the art without departing from the spirit and scope of the present invention as set forth in the accompanying claims.

We claim:

1. A composite winding type stacked-layer inductor having a stacked-layer structure formed by stacking plural sets of electrically conductive strips for forming plural sets of coils alternately with a plurality of electrically insulating members, wherein said electrically conductive strips in each of said sets are connected to the adjacent ones by way of edges of said electrically insulating members to thereby form a coil, at least two of said plural sets of the electrically conducting strips are each stacked in multiple layers in such a manner as to follow spiral paths superposed at two positions per each turn of the spiral paths around closely spaced axes in a direction opposite to each other with a nonsuperposed position between adjacent superposed positions, and wherein the coils formed by said at least two sets of the electrically conductive strips are connected to each other at least at an end portion of said coils with the end portions that are not connected being first and second end portions of the connected coils, turns of each of said coils being superposed on each other in the direction of said axes and said coils having substantially the same size, whereby magnetic flux generated by one of said coils is in the same direction as magnetic flux generated by the other of said coils, the spiral path being in the same direction from the first end portion to the second end portion of the connected coils.

2. A composite winding type inductor of a stacked layer structure as set forth in claim 1, wherein adjacent ones of said plural insulating members are configured in shapes complementary to each other.

3. A composite winding type inductor of a stacked-layer structure as set forth in claim 1, wherein said insulating members are formed by one selected from a group consisting of an electrically insulating magnetic member and a magnetic member having surfaces coated with an electrically insulating material.

4. A composite winding type inductor of a stacked-layer structure set forth in claim 2, wherein said insulation members are formed by one selected from a group consisting of an electrically insulating magnetic member and a magnetic member having surfaces coated with an electrically insulating material.

5. A composite winding type stacked-layer inductor set forth in claim 1, wherein said stacked-layer structure as a whole is sintered.

* * * * *